United States Patent [19]

Ignatowicz

[11] 4,280,746

[45] Jul. 28, 1981

[54] CONNECTOR ARRANGED TO PERMANENTLY LOCK ONTO A CABLE

[75] Inventor: Alexander M. Ignatowicz, Rutherford, N.J.

[73] Assignee: Western Electric Company, Inc., New York, N.Y.

[21] Appl. No.: 43,397

[22] Filed: May 25, 1979

[51] Int. Cl.[3] ..... H01R 13/58

[52] U.S. Cl. ..... 339/107

[58] Field of Search ..... 339/107, 106, 105, 104, 339/101, 103 R, 103 C, 103 M

[56] References Cited

U.S. PATENT DOCUMENTS

| | | | |
|---|---|---|---|
| 3,617,615 | 11/1971 | Balzer | 339/107 |
| 3,854,787 | 12/1974 | Snyder, Jr. | 339/103 R |
| 4,030,800 | 6/1977 | Vidoni et al. | 339/107 |
| 4,125,312 | 11/1978 | Aimar | 339/107 |

FOREIGN PATENT DOCUMENTS

| | | | |
|---|---|---|---|
| 476175 | 8/1951 | Canada | 339/103 C |
| 676144 | 7/1952 | United Kingdom | 339/62 |

*Primary Examiner*—Neil Abrams

*Attorney, Agent, or Firm*—J. J. Jordan; J. L. Landis

[57] ABSTRACT

A connector 10 (FIG. 1) is arranged with two hinged arms 30, 40 for protecting the terminations of electrical conductors 18 in the connector. Each of the two arms includes hood sections 31, 41, collar sections 32, 42 and clinching means 36, 46 arranged to mate with each other. As the arms 30, 40 are pivoted back over the termination end 21 of the connector, the clinching means 36, 46 mate with each other securely locking the collar section 32, 42 about the electrical conductors 18 thereby aligning the hood portions 31, 41 over the termination end 21 of the connector.

2 Claims, 5 Drawing Figures

CONNECTOR ARRANGED TO PERMANENTLY LOCK ONTO A CABLE

TECHNICAL FIELD

This invention relates generally to connectors and more particularly to connectors having covers to protect the electrical leads terminated therein.

BACKGROUND OF THE INVENTION

In many electrical connectors, particularly connectors which terminate a plurality of power leads, it is desired to have a connector which not only terminates the leads but which also affords permanent protection to the terminations on the back side, or rear, of the connector. Often, leads from the connector are removed and incorrectly reterminated in the connector, thereby causing damage to interconnected electrical equipment when the connector is reintroduced into an electrical circuit. Additionally, bare-backed connectors pose a threat of electrical hazard to both humans and equipment.

In the past, some protection has been afforded by having connectors which have covers which are held by screws, clasps or some other type clamping device. However, while protecting the connectors, these arrangements do permit the cover to be removed thereby allowing the electrical terminations to be tampered with. Other arrangements have covers which are secured to the electrical leads by clasps or screws, but these arrangements also permit removal of the covers to give access to the terminations within the connectors.

Another method of protecting terminated leads is to completely seal, or encapsulate, the rear end of the termination in plastic or some other non-conductive protective material. This prevents any tampering unless the connector is physically abused, but if one portion of the connector wears out or malfunctions, then the entire encapsulated device and part of the electrical leads terminated in the connector must be removed and discarded. Additionally, this type of connector does not lend itself to use in the field or on odd-size cable terminations since the connector is encapsulated onto the cable at time of cable manufacture and requires expensive encapsulation equipment.

In many of the above-mentioned arrangements, the protective covers can be removed, thus permitting tampering with the electrical connections, which can result in electrical hazards to anyone coming into contact with the uncovered terminations and can also cause further damage to interconnected electrical equipment. Furthermore, when damaged equipment is returned for service and repair, it is not always apparent what caused the damage when the power connector is one that can be easily opened and then closed with no physical evidence that the connector has been violated.

SUMMARY OF THE INVENTION

It is an object of the present invention to provide a connector which terminates electrical leads and comprises hood or cover means for permanently protecting the terminating end of the connector.

Another object of the invention is to provide means for clamping or securely holding the connector to the electrical leads.

A further object of the invention is to provide a connector wherein the hood-clamping means are structurally part of the connector.

A still further object is to provide a connector having means which permanently self-lock onto the electrical conductor terminated in the connector without requiring encapsulation.

A connector in accordance with certain features of the invention is designed for protecting a plurality of electrical leads terminated in a body or connector block portion of the connector. Such connector includes a plurality of arms pivotably mounted to the body of the connector, and having a hood or cover section shaped to fit over and enclose the ends of the leads adjacent to the body. The arms are provided with mating fasteners or clinching mechanisms for securely locking the arms together around the cable.

Preferably, two opposing arms are provided, hinged to the connector body and normally urged apart by the hinge construction. The clinching mechanism may include a pair of collar sections mounted at the ends of the arms and having mating clinching means for locking the collar sections together around the leads.

BRIEF DESCRIPTION OF THE DRAWINGS

Other objects, features and advantages of the invention, its organization, construction and operation will be best understood from the following detailed description of a specific embodiment thereof, taken in conjunction with the accompanying drawings in which.

DETAILED DESCRIPTION

Figure 1:
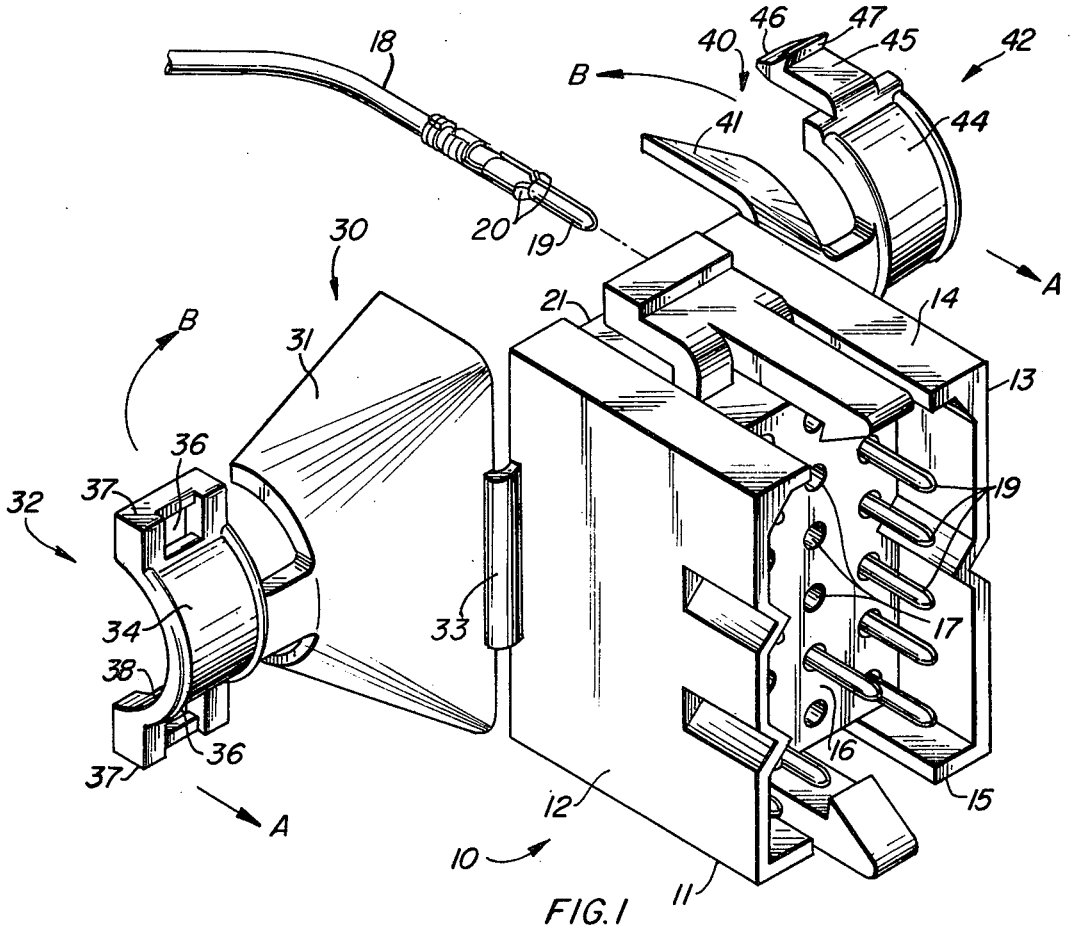
FIG. 1 is a perspective view of a connector in accordance with the invention, from a front end, with a pair of shielding-and-clamping arms open.
Figure 2:
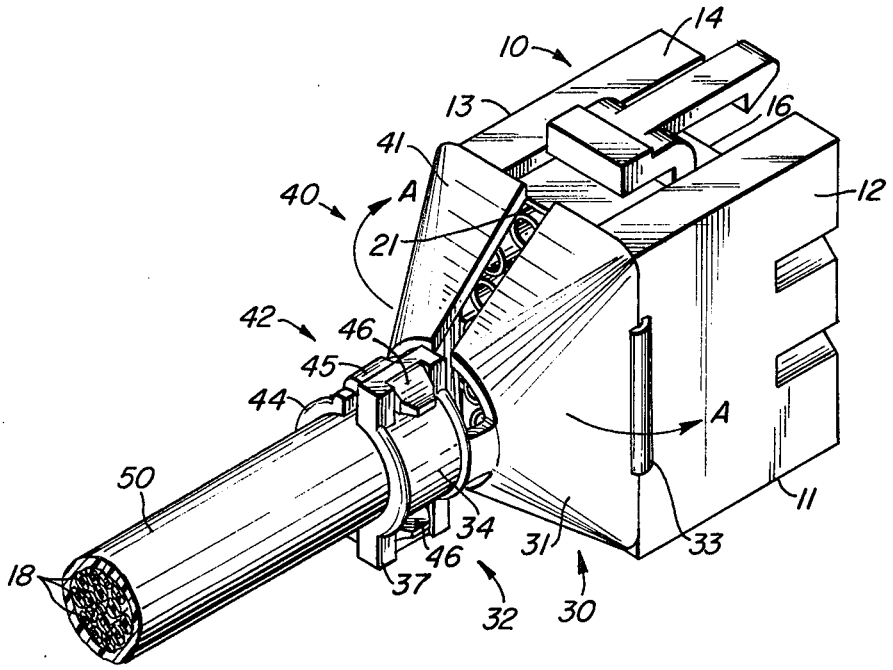
FIG. 2 is a perspective view of the connector from the rear or aft end, with the arms closed and clasped about a cable.
Figure 3:
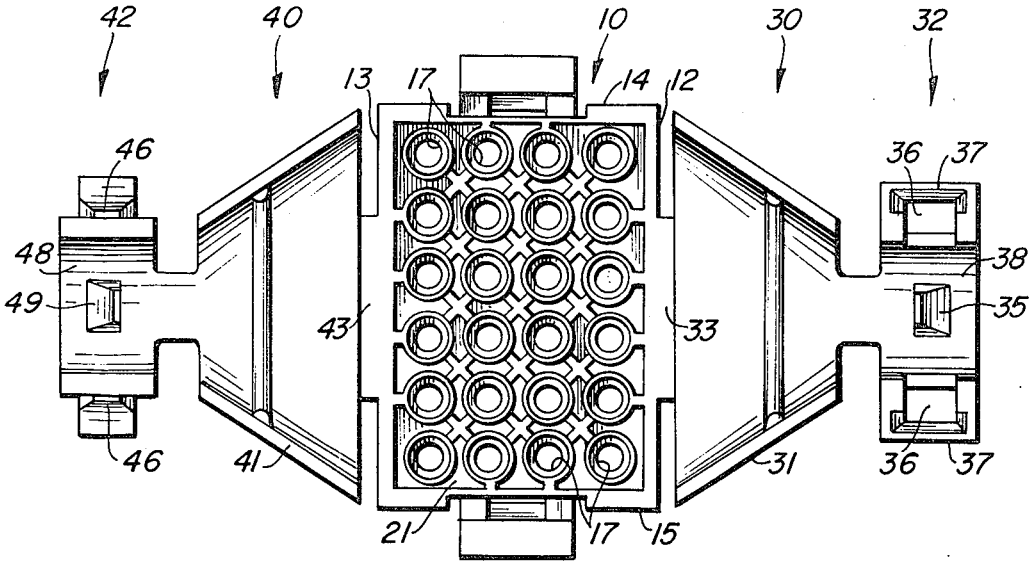
FIG. 3 is a view looking directly into the rear section of the connector, with the arms open and no cable terminated.

Preferably, the connector shown in FIGS. 1–3, generally designated 10, is a molded member of semirigid dielectric plastic material, such as nylon. A front end, or body 11, of connector 10, shown on the right side of FIG. 1, is arranged to accept electrical connector terminations. In the embodiment shown herein, the front end 11 of connector 10 is arranged as a box with two parallel vertical sides 12 and 13 molded to two parallel horizontal sides 14 and 15, and with a block 16 of the plastic enclosed in the box at the center and fixed to the sides 12–15 to form an integral unit 11.

The block 16 has running through it, from left to right in FIG. 1, a set of longitudinal holes or apertures 17 (twenty-four in a typical example), which define individual channels for accepting electrical terminations. In the example, the holes 17 are arranged in four columns of six holes each as shown in FIG. 1. An electrical conductor, or lead 18, terminated in a copper prong 19 adapted to securely fit into hole 17, is inserted into each hole 17 at the rear or termination end 21 of block 16. In conventional fashion, each prong 19 has a pair of resiliently mounted ears 20—20 mounted thereon, which, as the prong 19 is initially forced into the hole 17, are bent or deflected inward toward the body of the prong 19; but, as the prong 19 is pushed further into the hole 17, the ears 20—20 reach an indentation located in the wall of the hole 17 part way between the rear end 21 and front section 11 of the block 16. Upon reaching the indentation, the depressed ears 20 release and fit into the indentations, thereby securely holding the conductor 18 in the hole 17 with the tip of prong 19 jutting out from the front end 11 of the block 16, as shown at the right in FIG. 1. As described above, the embodiment shown herein contains 24 holes and 24 conductors, but any smaller number of conductors can be terminated therein. The twenty-four conductors 18 form a cable 50 which is terminated in the connector 10 as shown in FIG. 2. The above-described front end 11 of connector 10 is merely illustrative, and any connector which performs a similar function as the one described may also be advantageously employed.

As shown in FIGS. 1–3, connected to and preferably molded as integral pieces connected to the connector 10 are a pair of hinged arms 30 and 40, which extend outwardly in opposite directions from the rear or termination portion 21 of the connector. Each of the arms 30, 40 includes a hood or cover section 31, 41 and clamp or collar parts 32, 42, respectively.

The arms 30 and 40 are attached to the body of the connector by a pair of hinges 33, 43, which permit each of the arms to pivot toward and away from each other such that the hood 31, 41 on each arm covers and protects the termination portion 21 of the connector 10 when the arms are moved together as shown in FIG. 2. Further, the hinges 33, 43 are permanently disposed to exert a force, shown by arrow A of FIG. 1, which tends to urge the arms apart from each other. This is accomplished by the elastic characteristic of the material used in manufacturing the connector 10.

The arms 30 and 40 are equal in length so that, as the arms are moved toward each other, the collars 32, 42 are disposed equidistant from the rear portion 21 of the connector body 10 as seen in FIG. 2. Collar 42, located at the end of arm 40 as shown in FIGS. 1–4, and in particular in FIG. 4, comprises a central, semicircular, or arcuate, member 44. The semicircular member 44 is arranged with a rounded inner wall 48 on the side facing the other arm 30 when the arms are as shown in FIG. 2 and has a diameter smaller than the diameter of the conductor cable 50. Situated at the center of the semicircular member 44 and extending perpendicular from the inner wall 48 is a rectangular shaped tab 49.

Figure 4:
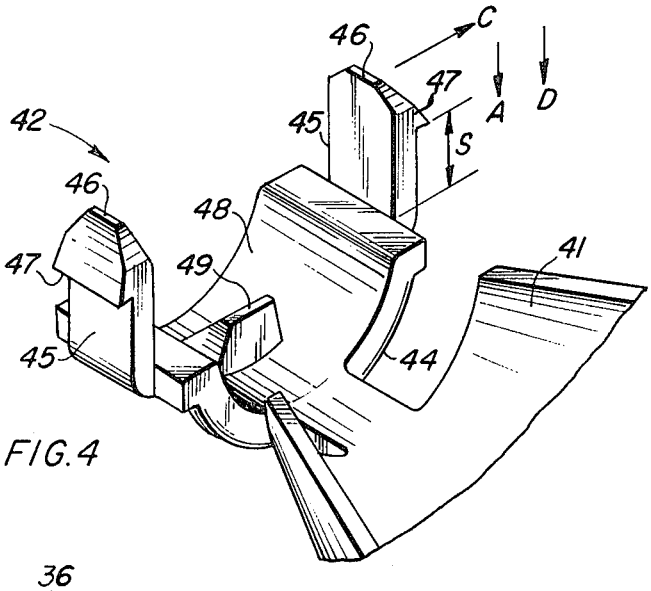
FIG. 4 is an enlarged perspective view of a first collar part located on one arm of the connector.

Extending in a tangential direction from and located at each end of the semicircular member 44 is clinching, or fastening, means which includes a tang 45 which is tapered at its end 46 as seen in FIG. 4. The side of the tapered end 46 which is opposite the semicircular member 44 has extending therefrom a prong or clasp 47 which rises perpendicular from the body of the tang 45 and extends down to the tapered end 46 of the tang 45 to form half an arrowhead as best shown in FIG. 4. The clasp 47 forms a slot with the end of the arcuate member 44 which is designated S in FIG. 4.

Figure 5:
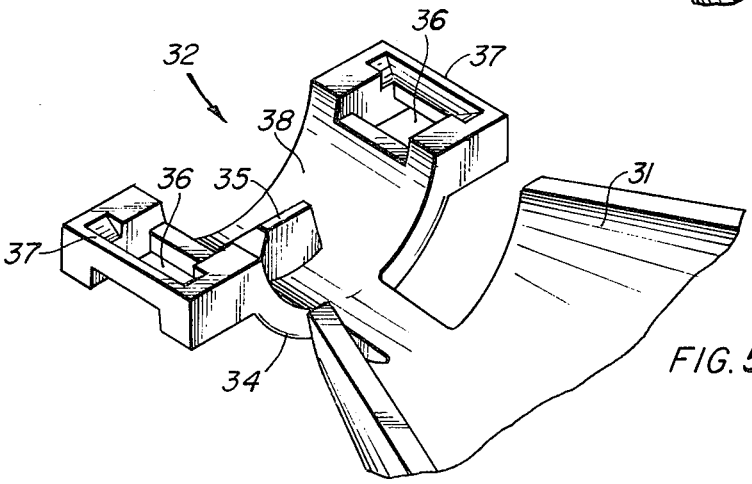
FIG. 5 is an enlarged perspective view of a second collar part located on the other arm of the connector.

As seen in FIGS. 1, 2, 3 and 5, the arm 30 has depending at its end a collar section 32 which comprises a centrally located semicircular, or arcuate, member 34. The diameter of the inner wall of member 34 is slightly larger than the diameter of the inner wall of arcuate member 44 located on arm 40 and the significance of this difference will be explained below. Located at the center of the semicircular member 34 and extending perpendicular from the inner wall 38 of member 34 is a tab 35 as seen in FIG. 5. Each end of the semicircular member 34 has located on it and depending laterally from it clinching, or fastening, means which inlcudes a rectangular shaped hole 36, for receiving one of the tangs 45 located on the end of arm 40 when collars 32 and 42 are mated as seen in FIG. 2. The outer walls 37, 37 of holes 36, 36 are sufficiently thick to fit into the slots S formed by the clasps 47, 47.

The hood portions 31, 41 of the arms 30, 40 are truncated-pyramid shaped as shown in FIGS. 1, 2. The bottom part of each hood portion 31, 41 is as long as the vertical sides 12, 13 of the connector 10 and is slightly less than half the width of the horizontal sides 15, 16 of the connector. As will be discussed in detail below, the hood is slightly less than half the width in order to permit the collar portions 32, 42 of the arms 30, 40 to properly mate, while also affording maximum protection to the termination end 21 of the connector 10.

When the two arms 30, 40 are brought together and mounted behind the rear section 21 of connector 10, the hood portions 31, 41 form a truncated-pyramid shaped cover to allow entrance of the connector cable 50 through collar sections 32, 42 and for protecting the electrical conductors terminated in the connector as shown in FIG. 2.

To assemble the cable 50 with the connector 10, the prongs 19 at the front end of each individual cable lead 18 are first inserted into the corresponding sockets or mounting holes 17 of the connector block 16 and secured therein to terminate the cable 50 as previously described and with the connector arms 30 and 40 biased open at this time, as shown in FIG. 1. At this time, an outer cylindrical jacket of the multiconductor cable 50 is positioned adjacent to the rear face 21 of the connector body 11 and occupies a position centrally located between the locking collars 32 and 42. After this, to protect the termination, the hinged arms 30 and 40 are moved toward each other, as indicated by arrows B in FIG. 1, to lock the collars 32 and 42 together as shown in FIG. 2. As described above, since the hinges 33 and 44 exert a force (arrows A) tending to keep the arms 30 and 40 apart, sufficient external force must be applied to overcome the inherent structural force exerted by the hinges 33 and 43.

As the arms 30 and 40 approach each other, the tangs 45—45 extending tangentially away from collar 42 will first make contact with the inside of the outer walls 37—37 of holes 36—36. As further closing force is applied, the tapered outside surface of the arrow-shaped clasp 47 of each tang slides along the inner surface of the outside wall 37 of each corresponding hole 36 as the arms 30 and 40 are forced toward each other. As the arrowhead comes into further contact with the hole, the tangs 45 are depressed in and toward each other until the arrowhead portion 47 passes the wall 37 of the hole, the wall 37 fitting into slot S, at which time the tangs 45, 45 snap back and are now prevented from pulling out of the holes 36, 36 by the arrowhead clasp 47 which is restrained and captures by outside wall 37 of each hole 36 as seen in FIG. 2.

As described above, the diameter of the semicircular member 44 on arm 40 is slightly less than the diameter of the corresponding semicircular member 34 on arm 30. As the arms are brought into contact with each other, tabs 35 and 49, located on the inside wall of members 34 and 44, respectively, and jutting perpendicular from the walls, come into contact with and bite into the insulating jacket of deformable plastic material, of cable 50. Since the member 44 has a diameter which is slightly less than the diameter of the cable 50, semicircular member 44 will be forced open to accommodate the cable. As the arms 30 and 40 are brought into further contact with the cable and each other, the member 44 is forced to spread further apart thereby pushing each of tangs 45, 45 in a direction away from the other, as shown by arrow C in FIG. 4. However, the tangs 45, 45 have already come into contact with and are constrained by the outer walls 37—37 of corresponding holes 36—36 as described above. Semicircular member 34 of collar part 32 has a larger diameter than member 44 and thus holes 36, 36 are not forced apart. As the arms 30 and 40 are moved toward each other, the lips 45, 45 are forced further into each hole until the widest point of the arrowhead 47 of each lip 45 is no longer in contact with the side 37 of the hole 36 and the tang springs back in a direction away from the cable 50. The tangs 45—45 on arms 40 have now been fully inserted into and mated with the corresponding holes 36—36 on arm 30 thereby locking arm 30 and arm 40 together. Hood sections 31 and 41 are now aligned with each other to form a protective cover over the rear portion 21 of connector 10 as seen in FIG. 2.

It is to be noted that arms 30 and 40 are permanently mated with each other by the forces generated by the design of the connector 10. Hinges 33 and 43 are exerting a force (arrow A) attempting to open arms 30 and 40 and have lips 45—45 pull out of holes 36—36. Tabs 35 and 49, which exert forces perpendicular to the surface of cable 50 with which they are in contact, also attempt to force arms 30 and 40 apart (arrow D). Arcuate member 44, which has a smaller diameter than cable 50, exerts a force on tangs 45, 45 which tends to push the tangs 45, 45 further apart from each other. Since the clasps 47—47 on tangs 45—45 are held by arms 37—37 of holes 36—36 as seen in FIG. 2, the above-mentioned forces now capture and securely lock the tangs onto the arms 37—37 such that the tangs 45—45 cannot be removed from the holes 36—36 without damaging the arms 30, 40 of the connector 10. Additionally, the tabs 35–49, which bite into and securely clasp the cable, thereby prevent the cable from pulling out of the connector and provide strain relief.

With arms 30–40 securely locked about cable 50 by collar sections 32–42, hood sections 31–41 now cover and protect the termination end 21 of connector 10. Because of the forces exerted on collar sections 32–42 when they are closed about cable 50 as described above, the arms 30–40 of connector 10 cannot be opened unless they are physically damaged. Thus the electrical conductor 18 terminations in connector 10 are protected and cannot be tampered with unless the connector 10 is physically damaged. Moreover, the connector 10 can be attached to cable 50 in the field and does not require expensive encapsulating machinery.

While one specific example and embodiment of the invention has been described in detail hereinabove, it should be obvious that various modifications may be made from the specific details, steps and materials described without departing from the spirit and scope of the invention.

What is claimed is:

1. An electrical connector for terminating in a body of the connector a plurality of electrical conductors formed into a cable having a known diameter and for protecting the terminations by becoming permanently locked onto the terminated cable, comprising:

a pair of arms connected to and extending from opposite sides of the connector body, the arms being connected to the connector body by hinges which urge the arms to remain apart but which permit the arms to be forced together over the termination end of the connector body, each arm including a cover section for enclosing portions of the leads adjacent to the connector body and a first or a second collar section mounted at the end of the cover section;

wherein the first collar section comprises an arcuate member having a diameter no larger than the diameter of the cable, a tab attached to and extending perpendicular to the inner wall of the arcuate member for forcibly contacting and securely clasping the cable and a pair of receiving means, each of the receiving means being located at the ends of the arcuate member; and the second collar section comprises an arcuate member having a diameter which is smaller than the diameter of the arcuate member of the first collar section, a tab attached to and extending perpendicular to the inner wall of the arcuate member for forcibly contacting and securely clasping the cable and a pair of clasps, each of the clasps being located at an end of and extending perpendicular from the arcuate member and adapted to initially contact and then lock into the receiving means as the two arms are moved into contact with each other, such that when the pair of arms are forced together over the termination end of the connector body to overcome the forces exerted by the hinges attempting to keep the arms apart, the pair of clasps initially contact the pair of receiving means, and as the arms are brought into further contact with the cable the second collar section is forced open, since its arcuate member has a diameter which is smaller than the diameter of the first arcuate member, thereby pushing the pair of clasps away from each other and into permanent locking relationships with the pair of receiving means, the hinges, which exert a force urging the arms to remain apart, further add to the permanent locking relationship, so that the first and second collar sections are permanently locked onto the cable thus enclosing the portions of the leads adjacent to the connector body with the cover sections.

2. In combination a cable comprising a plurality of electrical leads;

an electrical connector for terminating the electrical leads and for permanently locking onto the cable to protect the terminations, the connector comprising:

a body in which the electrical leads are individually terminated;

a pair of arms which are connected to opposite sides of the body by hinges which are adapted to urge the arms to remain apart, each of the arms including a hood portion and a first or a second collar section mounted at the end of the hood portion of the arm and arranged to securely lock onto the cable;

wherein the first collar section comprises:

a semicircular member having a diameter approximately the same size as the diameter of the cable;

a rigid tab located in the semicircular member and extending perpendicular therefrom for contacting the cable when the first and second collar sections are fastened together to securely clamp the cable between the collar sections; and a pair of receptacles, each receptacle having a hole depending laterally from an end of the semicircular member; and wherein the second collar section comprises:

a semicircular member having a diameter which is smaller than the diameter of the cable;

a rigid tab located in the semicircular member and extending perpendicular therefrom for contacting the cable when the collar sections are fastened together to securely clamp the cable between the collar sections; and a pair of half-arrowhead tangs extending tangentially from the ends of the semicircular member, each of the tangs shaped to fit into each of the holes located on the first collar section and of sufficient length so that the tangs initially contact the receptacles located on the first collar section when the arms are moved toward each other, such that when the two hinged arms are moved toward each other over the termination end of the connector body, the half-arrowhead tangs first make contact with the inside of the walls of the holes in the receptacles and as the hinged arms are moved closer to each other, the rigid tabs contact and clamp the cable, the tangs are further pushed into the holes and snap into locking relationship with the receptacles since the semicircular member from which the pair of tangs extend has a smaller diameter than the diameter of the cable and is being forced to spread apart as it comes into contact with the cable thereby pushing the tangs away from each other to lock in the receptacles, and the hinged arms which are urging the arms to remain apart further lock the tangs in the receptacles, such that the connector is permanently locked onto the terminated cable.

* * * * *